US008061970B2

(12) United States Patent
Maier et al.

(10) Patent No.: US 8,061,970 B2
(45) Date of Patent: Nov. 22, 2011

(54) COMPACT SHAFT SUPPORT DEVICE FOR TURBOMACHINES

(75) Inventors: William C. Maier, Almond, NY (US); David J. Peer, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 531 days.

(21) Appl. No.: 12/355,080

(22) Filed: Jan. 16, 2009

(65) Prior Publication Data

US 2010/0183438 A1 Jul. 22, 2010

(51) Int. Cl.
*F01D 3/00* (2006.01)

(52) U.S. Cl. ..... 415/104; 415/229

(58) Field of Classification Search ..... 415/229, 415/230, 231, 104, 107
See application file for complete search history.

(56) References Cited

U.S. PATENT DOCUMENTS 4,306,834 A * 12/1981 Lee ..... 415/116
4,453,837 A * 6/1984 Shimizu et al. ..... 384/121
4,557,664 A * 12/1985 Tuttle et al. ..... 415/105
4,867,633 A * 9/1989 Gravelle ..... 415/106
4,884,942 A * 12/1989 Pennink ..... 415/104
4,997,340 A * 3/1991 Zinsmeyer et al. ..... 415/105
5,302,091 A * 4/1994 Horiuchi ..... 417/420
5,310,311 A * 5/1994 Andres et al. ..... 415/229
5,340,272 A * 8/1994 Fehlau ..... 415/110
5,425,345 A * 6/1995 Lawrence et al. ..... 123/559.1
5,713,720 A * 2/1998 Barhoum ..... 415/104
5,791,868 A * 8/1998 Bosley et al. ..... 415/104
5,827,040 A * 10/1998 Bosley et al. ..... 415/106
RE36,101 E * 2/1999 Andres et al. ..... 415/229
5,927,720 A * 7/1999 Zinsmeyer et al. ..... 277/303
5,957,656 A * 9/1999 De Long ..... 415/104
6,036,435 A * 3/2000 Oklejas ..... 415/111
6,232,688 B1 * 5/2001 Ress et al. ..... 310/90.5
6,367,241 B1 * 4/2002 Ress et al. ..... 60/784
6,609,882 B2 * 8/2003 Urlichs ..... 415/104
6,957,945 B2 * 10/2005 Tong et al. ..... 415/1
6,966,746 B2 * 11/2005 Cardenas et al. ..... 415/1
7,004,719 B2 * 2/2006 Baldassarre et al. ..... 415/105
7,048,495 B2 * 5/2006 Osgood ..... 415/104
7,144,226 B2 * 12/2006 Pugnet et al. ..... 417/244
7,703,290 B2 * 4/2010 Bladon et al. ..... 60/804
2002/0197150 A1 * 12/2002 Urlichs ..... 415/104
2004/0086376 A1 * 5/2004 Baldassarre et al. ..... 415/107
2004/0101395 A1 * 5/2004 Tong et al. ..... 415/1
2004/0179961 A1 * 9/2004 Pugnet et al. ..... 417/423.5
2005/0106015 A1 * 5/2005 Osgood ..... 415/216.1
2006/0140747 A1 * 6/2006 Vandervort et al. ..... 415/1
2006/0186671 A1 * 8/2006 Honda et al. ..... 290/54
2007/0122265 A1 * 5/2007 Ansari et al. ..... 415/104
2008/0101929 A1 * 5/2008 Allen et al. ..... 415/229
2008/0317584 A1 * 12/2008 Murase et al. ..... 415/112
2009/0309439 A1 * 12/2009 Yamamoto ..... 310/90
2009/0311089 A1 * 12/2009 Begin et al. ..... 415/104

(Continued)

*Primary Examiner* — Ross Gushi
(74) *Attorney, Agent, or Firm* — Edmonds & Nolte, PC

(57) ABSTRACT

A shaft support device for a turbomachine including a rotary body and a stationary body. The rotary body is attached to a shaft of the turbomachine, and includes a first portion and a second portion. The first portion has a thrust bearing collar and the second portion has a thrust balance piston. The first and second portions are axially overlapping. The stationary body is fixably attached to a casing of the turbomachine. The stationary body has a first thrust bearing portion that is disposed adjacent to and operatively engages the first portion of the rotary body.

20 Claims, 6 Drawing Sheets

U.S. PATENT DOCUMENTS

2010/0080686 A1* 4/2010 Teragaki ..... 415/112
2010/0129212 A1* 5/2010 Berger et al. ..... 415/229
2010/0139270 A1* 6/2010 Koch et al. ..... 60/605.3
2010/0180589 A1* 7/2010 Berger et al. ..... 60/598
2010/0183438 A1* 7/2010 Maier et al. ..... 415/229
2010/0310366 A1* 12/2010 Eguchi et al. ..... 415/229
2011/0038716 A1* 2/2011 Frankenstein et al. ..... 415/170.1
2011/0052432 A1* 3/2011 Cunningham et al. ..... 417/423.3

* cited by examiner

COMPACT SHAFT SUPPORT DEVICE FOR TURBOMACHINES

BACKGROUND

The present disclosure relates to fluid machinery, and more particularly to shaft support devices, such as bearings, for rotating components of fluid machinery.

Turbomachines, such as centrifugal compressors, may include a rotatable shaft and one or more working components (e.g., impellers) mounted on the shaft. During use of the turbomachine, the shaft is subjected to various axial and radial loads. To support the rotating shaft and various loads on the shaft, one or more shaft support devices, such as bearings, balance pistons, etc., may be provided.

Certain shaft support devices support radial loading, such as journal or rolling element bearings, while other shaft support devices, such as thrust bearings, balance pistons, etc., support axial loading on the shaft. Typically, the various shaft support devices may be spaced at least partially axially along the shaft. Thus, to accommodate the various shaft support devices, it may be necessary to increase the axial length of the shaft, which may increase the size and cost of the turbomachine.

SUMMARY

Embodiments of the disclosure may provide a shaft support device for a turbomachine including a rotary body attached to a shaft of the turbomachine. The rotary body includes an inner portion having a thrust balance piston, and an outer portion having a thrust bearing collar. The outer portion is disposed at least partially radially outward from the inner portion and axially overlaps the inner portion. The exemplary shaft support device further includes a stationary body disposed within and fixably connected to a casing of the turbomachine. The stationary body includes a thrust bearing portion operatively engaging the thrust bearing collar of the outer portion of the rotary body, and sealingly engaging the inner portion of the rotary body.

Embodiments of the disclosure may further provide a shaft support device for a turbomachine including a rotary body attached to a shaft of the turbomachine. The rotary body includes a first portion having a thrust balance piston and a second portion having a thrust bearing collar. The first and second portions are axially overlapping. The exemplary shaft support device further includes a stationary body fixably attached to a casing of the turbomachine. The stationary body includes a first thrust bearing portion disposed adjacent to and operatively engages the first portion of the rotary body.

Embodiments of the disclosure may also provide a shaft support device for a turbomachine including a rotary body connected to a shaft of the turbomachine. The rotary body includes a plurality of thrust bearing collars, each of which is at least partially axially overlapping another one of the plurality of thrust bearing collars. The exemplary shaft support device also includes a stationary body fixably connected to a casing of the turbomachine. The stationary body includes a plurality of thrust bearing portions, each of which is disposed adjacent to and operatively engages one of the plurality of thrust bearing collars.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
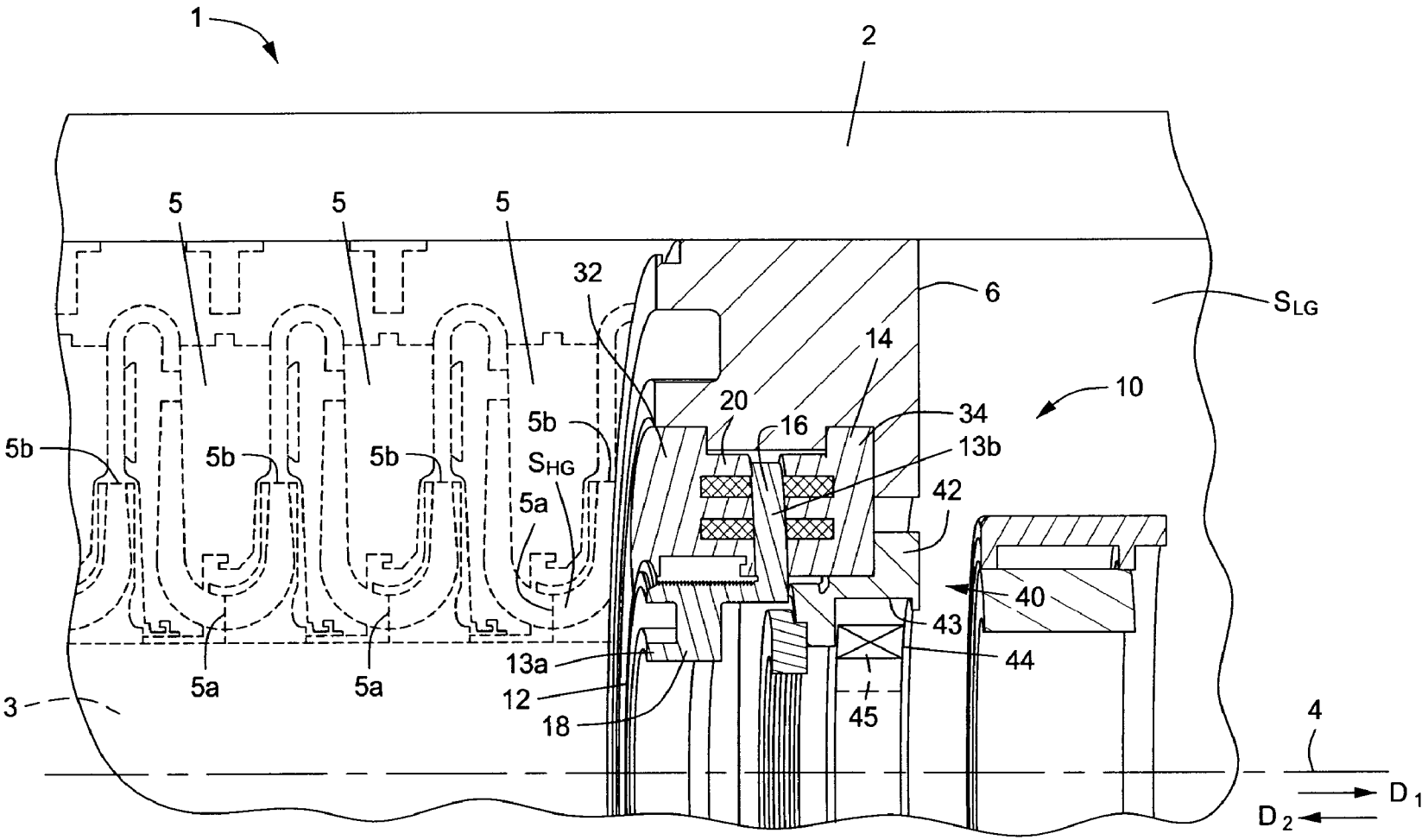
FIG. 1 illustrates a partial axial cross-sectional perspective view of an embodiment of a compressor in accordance with the disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

Referring now to the drawings in detail, wherein like numbers are used to indicate like elements throughout, there is shown in FIG. 1 a shaft support device 10 for a turbomachine 1. The turbomachine 1 may include a casing 2 and a shaft 3 disposed in the casing 2 which is rotatable about a central axis 4. The shaft support device 10 includes a rotary body 12 connected with the shaft 3 so as to be rotatable about the central axis 4. The shaft support device 10 also includes a stationary body 14 that is disposed within and fixedly connected to the casing 2 and is immovable with respect to the central axis 4.

The rotary body 12 includes first and second portions 13*a* and 13*b*, respectively. In an exemplary embodiment, the second portion 13*b* may be disposed at least partially radially outward from the first portion 13*a*, and therefore the first portion 13*a* may be described herein as the inner portion 13*a*, and the second portion 13*b* may be described herein as the outer portion 13*b*. It will be appreciated, however, that the described relative location of the first and second portions 13*a*, 13*b* is merely exemplary and other arrangements of the first and second portions 13*a*, 13*b*, including the reverse of that just described, are contemplated herein. Each of the inner and outer portions 13*a*, 13*b* are configured to provide one or more thrust bearing collars and/or one or more thrust balance pistons. In the exemplary embodiment shown in FIGS. 1-4, the outer portion 13*b* provides a thrust bearing collar 16 and the inner portion provides a thrust balance piston 18. In the exemplary embodiment shown in FIG. 6, the inner and outer portions 13*a*, 13*b* are each configured to provide the thrust bearing collar 16. In other embodiments, the inner portion 13*a* may provide the thrust bearing collar 16, and the outer portion 13*b* may provide the thrust balance piston 18 (structure not shown). In other exemplary embodiments, the inner and outer portions 13*a*, 13*b* may include other arrangements of thrust bearing collars and thrust balance pistons.

Figure 4:
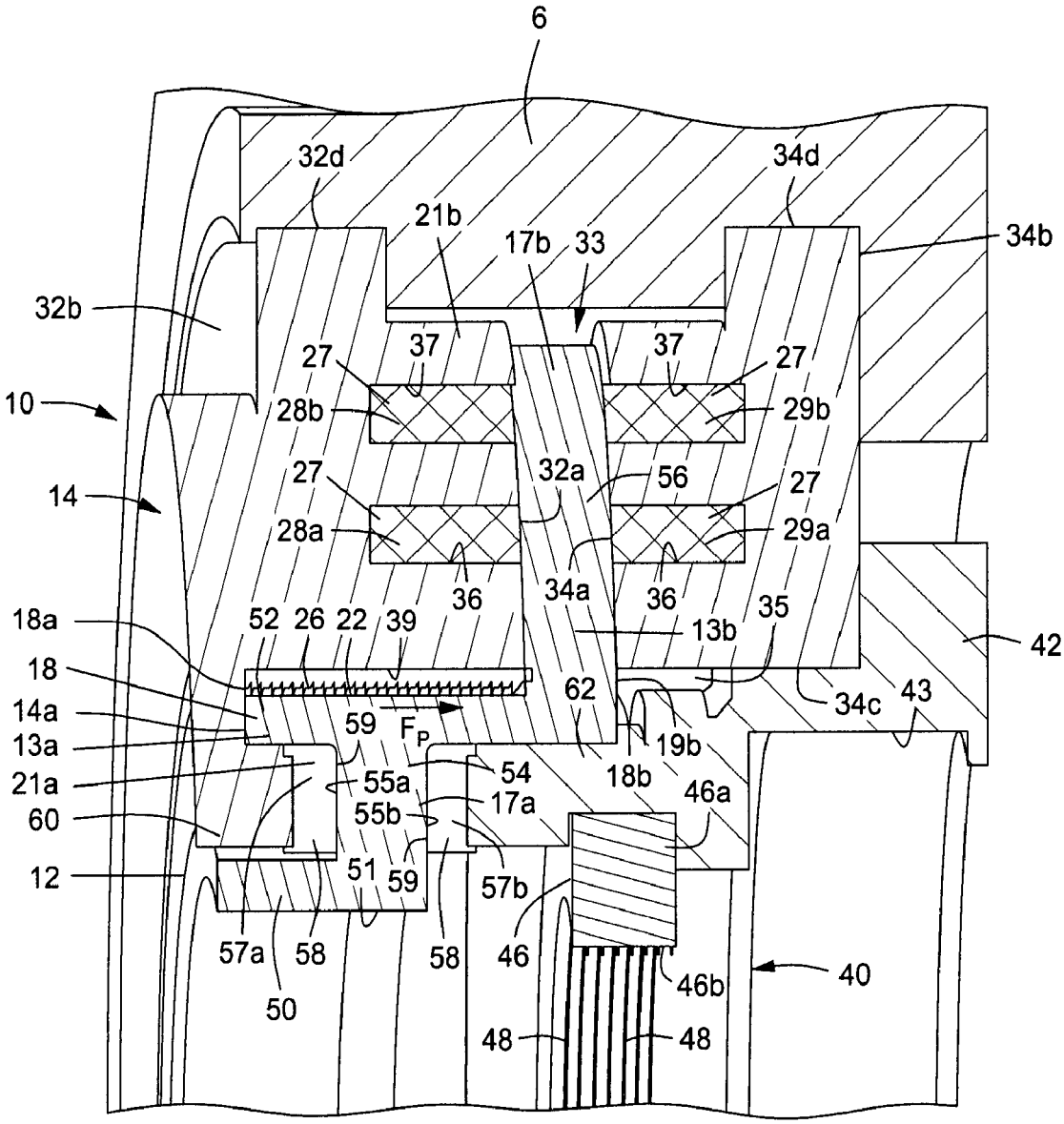
FIG. 4 illustrates a partly broken-away, enlarged, axial cross-sectional view in perspective of an embodiment of the shaft support device in accordance with the disclosure.
Figure 5:
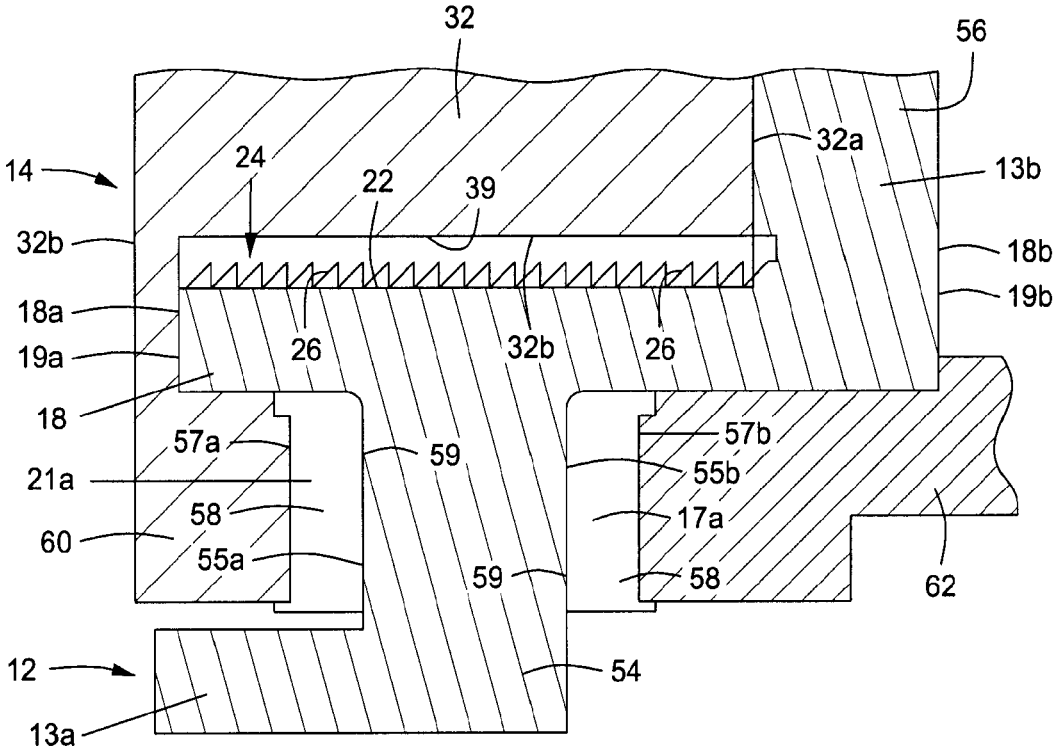
FIG. 5 illustrates an enlarged, axial cross-sectional view of a portion of an embodiment of the shaft support device in accordance with the disclosure.
Figure 6:
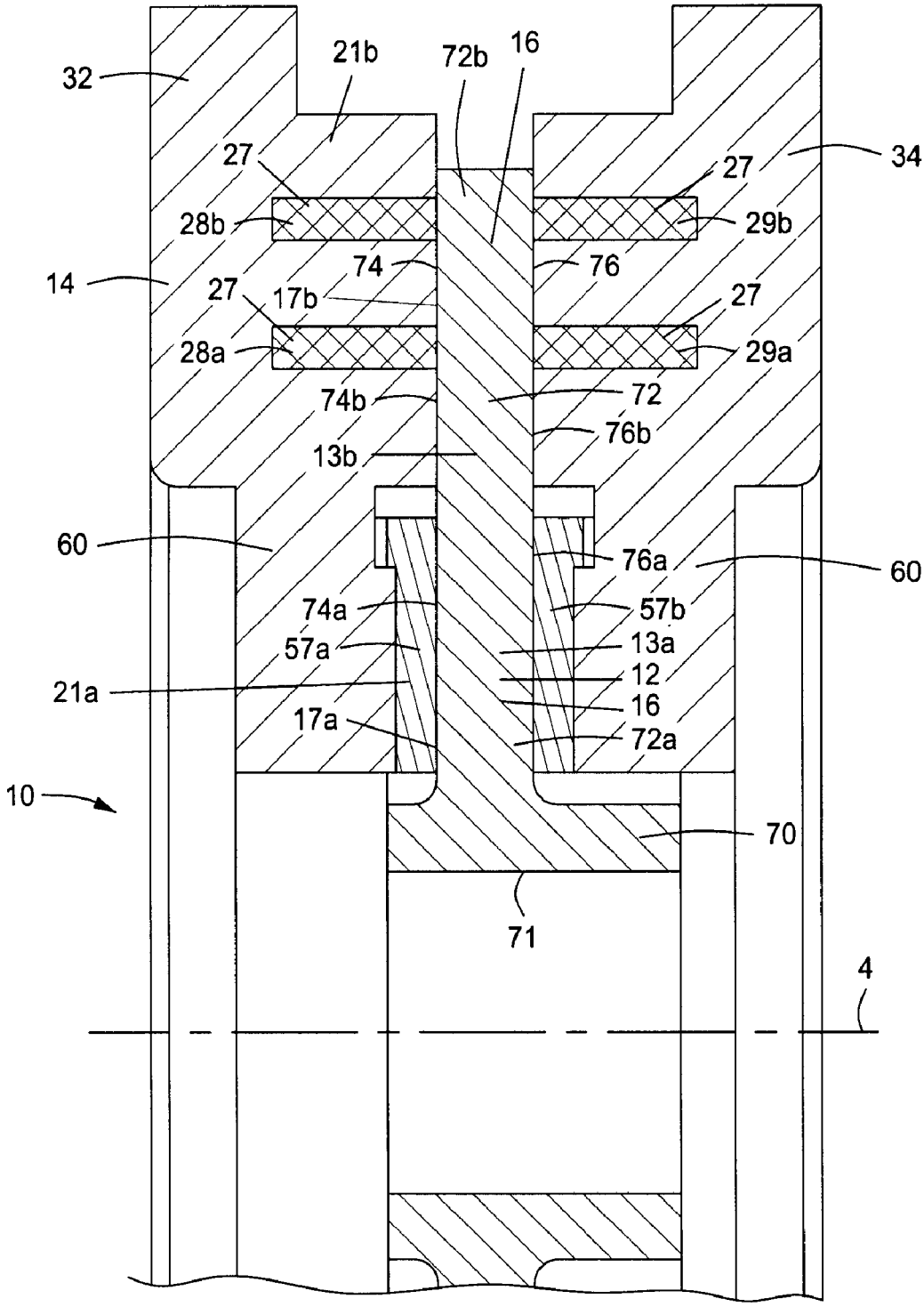
FIG. 6 illustrates a broken-away, axial cross-sectional view of a shaft support device in accordance with the disclosure.

Further, the stationary body 14 includes at least one thrust bearing portion 20 that may be disposed adjacent to the outer portion 13b; however, in other exemplary embodiments, the thrust bearing portion 20 may be disposed adjacent to the inner portion 13*a*. In an exemplary embodiment, the thrust bearing portion 20 is operatively engageable with the outer portion 13*b*, so as to support axial loading on the shaft 3 and/or to substantially prevent axial displacement of the shaft 3. The stationary body 14 may include the thrust bearing portion 20, as shown in FIGS. 1-3, and in other embodiments, examples of which are shown in FIGS. 4-6, the stationary body 14 may include first and second thrust bearing portions 21*a*, 21*b*, which may also be described herein as inner and outer thrust bearing portions 21*a*, 21*b*, and may even include additional thrust bearing portions (not shown).

As shown in FIG. 1, in an exemplary embodiment, the outer portion 13*b* of the rotary body 12 extends at least partially circumferentially about the inner portion 13*a*, such that the inner and outer portions 13*a*, 13*b* are axially overlapping. Accordingly, the axial extent or length of the rotary body 12, and therefore also the stationary body 14 and the shaft 3, is minimized or reduced in comparison to previously known shaft support devices.

Figure 2:
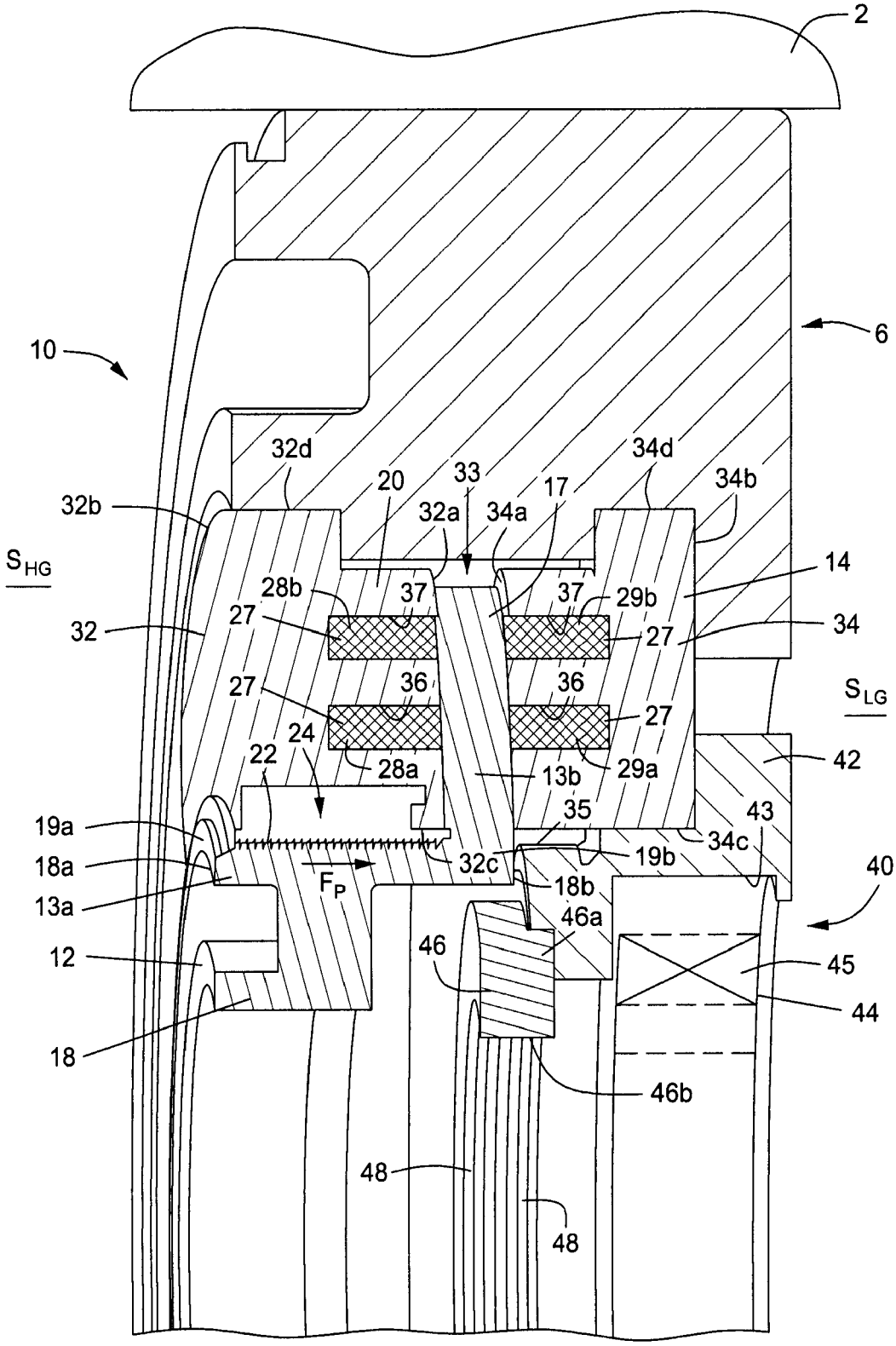
FIG. 2 illustrates an enlarged, axial cross-sectional view of an embodiment of a shaft support device in accordance with the disclosure.
Figure 3:
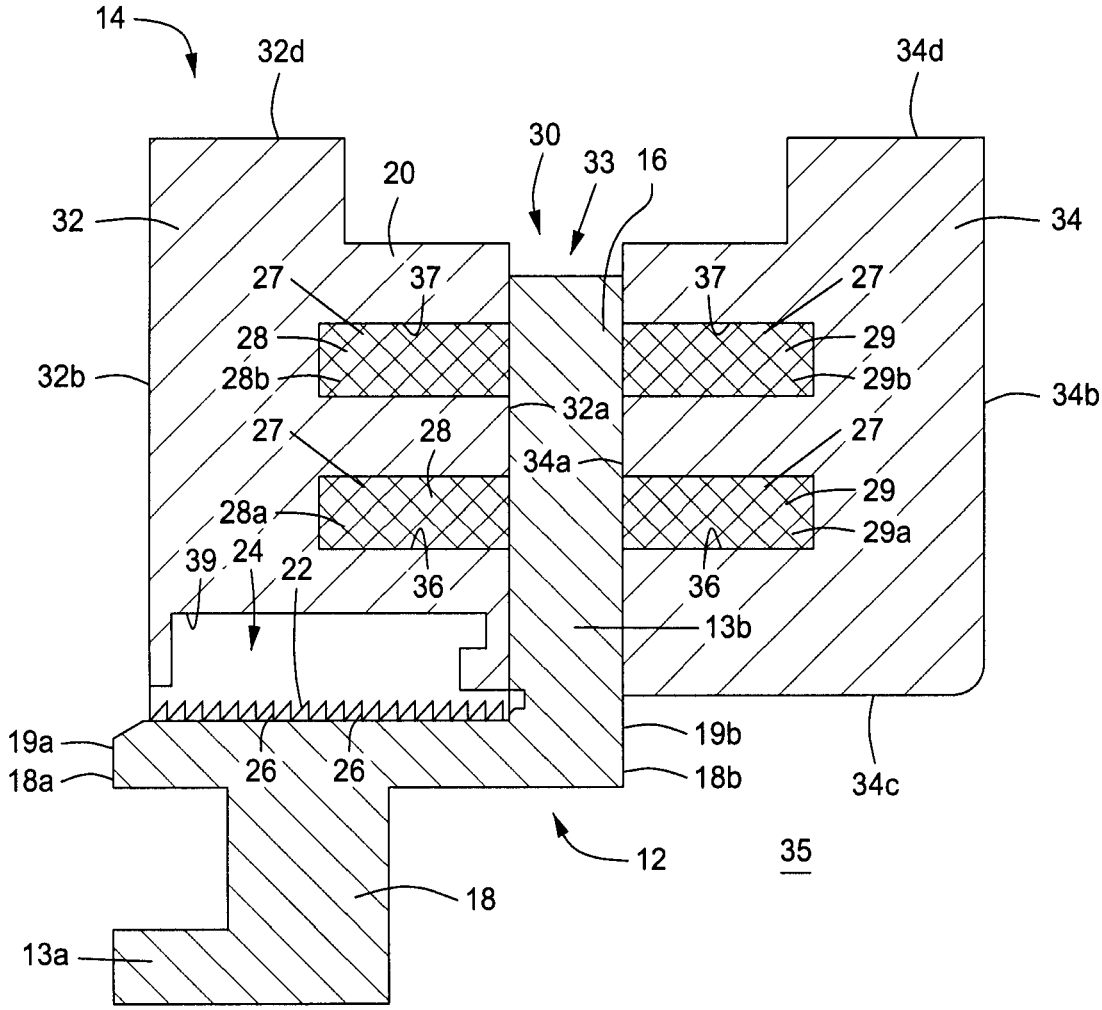
FIG. 3 illustrates an enlarged view of the embodiment of the shaft support device of FIG. 2, shown without a radial bearing assembly in accordance with the disclosure.

Referring now to FIGS. 1-3, in an exemplary embodiment, the inner portion 13*a* provides the thrust balance piston 18, which has opposing first and second axial ends 18*a*, 18*b* spaced axially apart along the central axis 4. The thrust bearing portion 20 of the stationary body 14 is engageable with the outer portion 13*b* of the rotary body 12. It will be appreciated, however, that in other exemplary embodiments, the outer portion 13*b* may provide the thrust balance piston 18, and the thrust bearing portion 20 may be engageable with the inner portion 13*a*. Further, the inner and outer portions 13*a*, 13*b* of the rotary body 12 may be integrally formed, such that the rotary body 12 may be of one-piece construction, or may instead be formed of two or more separate members connected by any appropriate means known in the art. The first axial end 18*a* of the thrust balance piston 18 may include a first pressure surface 19*a*, which may be generally radial. The first pressure surface 19*a* is exposeable to a source of relatively higher pressure gas $S_{HG}$ during operation of the turbomachine 1. The second axial end 18*b* may have a second pressure surface 19*b*, which may be generally radial and exposeable to a source of relatively lower pressure gas $S_{LG}$. As such, a net axial pressure force $F_P$ may be exerted on the shaft 3 in a first axial direction $D_1$ oriented generally along the central axis 4 during operation of the turbomachine 1.

The turbomachine 1 may be a centrifugal compressor including at least one impeller 5, and each impeller 5 may have an impeller outlet 5*b* and an impeller inlet 5*a*. As such, the thrust balance piston 18 generates the axial pressure force $F_P$ to counteract any opposing axial forces which result from the pressure differential between the axially spaced impeller outlet(s) 5*b* and impeller inlet(s) 5*a*.

In an exemplary embodiment, the inner portion 13*a* of the rotary body 12 includes an outer circumferential surface 22 extending generally between the first and second axial ends 18*a*, 18*b* of the thrust balance piston 18, and the stationary body 14 includes a seal 24. The seal 24 is configured to engage the outer circumferential surface 22 so that the seal 24 prevents substantial fluid flow generally between the first and second axial ends 18*a*, 18*b*. The seal 24 may be a generally annular labyrinth seal including a plurality of radially inwardly extending annular shoulders or "teeth" 26 that are slidably engageable with the outer circumferential surface 22 of the rotary body 12, but the seal 24 may also be constructed in any other appropriate manner.

In an exemplary embodiment, the outer portion 13*b* includes the thrust bearing collar 16 and the stationary body 14 includes at least one magnet 27. The thrust bearing collar 16 and the at least one magnet 27 together provide a magnetic thrust bearing 30, which may be known in the art as an active magnetic bearing (AMB). In an exemplary embodiment, the at least one magnet 27 of an AMB may include an electromagnet. Using an electromagnet may allow the magnetic thrust bearing 30 to control the position of the rotary body 12. That is, the at least one magnet 27 may be configured to exert force on the thrust bearing collar 16 so that the at least one magnet 27 biases the rotary body 12 generally axially toward the at least one magnet 27. Accordingly, the at least one magnet 27 may act on the thrust bearing collar 16 to counteract axial forces on the shaft 3. The magnetic force biases the thrust bearing collar 16, and thus the rotary body 12 and ultimately the shaft 3, in a direction opposing net axial forces arising from such factors as pressure differentials on the impellers 5, and the like.

In another exemplary embodiment, the at least one magnet 27 may include only permanent magnets. If the at least one magnet 27 only includes permanent magnets, the magnetic thrust bearing 30 may counteract thrust forces on the shaft 3, but may not actively control the position of the rotary body 12 in some embodiments.

Referring to FIGS. 2-5, in an exemplary embodiment of the shaft support device 10, the stationary body 14 includes first and second body sections 32 and 34, which are spaced apart along in the axial direction to define a gap therebetween. The first and second body sections 32, 34 are generally annular and include inner axial end surfaces 32*a*, 34*a*, respectively, which extend radially. The inner axial end surface 32*a* faces generally toward the second body section 34, and the inner axial end surface 34*a* faces generally toward the first body section 32. The first and second body sections 32, 34 also respectively include outer axial end surfaces 32*b*, 34*b* extending radially, inner circumferential surfaces 32*c*, 34*c* together defining a central bore 35, and outer circumferential surfaces 32*d*, 34*d*. In an exemplary embodiment, both of the inner axial end surfaces 32*a*, 34*a* include two (i.e., inner and outer) annular grooves 36, 37 that extend axially inwardly from the inner axial end surfaces 32*a*, 34*a*.

The at least one magnet 27 may be first and second magnets 28, 29. In an exemplary embodiment, the first magnet 28 is disposed in the first body section 32, and the second magnet is disposed in the second body section 34. The thrust bearing collar 16 may be disposed between the first and second magnets 28, 29. Accordingly, the first magnet 28 may be configured to bias the thrust bearing collar 16 in an axial direction $D_2$ (see FIG. 1) toward the first magnet 28, and the second magnet 29 may be configured to bias the thrust bearing collar 16 in the axial direction $D_1$ toward the second magnet 29. As can be appreciated from FIG. 1, the axial direction $D_1$ and the axial direction $D_2$ are oriented substantially opposite to one another, such that, for example, a force the axial direction $D_1$ would be substantially cancelled out by a force of equal magnitude in the other axial direction $D_2$. Further, it will be appreciated that the magnets 28, 29 may be configured to bias the rotary body 12 in either axial direction $D_1$, $D_2$, by changing the polarity of the magnets 28, 29.

Accordingly, the magnetic thrust bearing 30 may be formed between the outer portion 13*b* and the first and second body sections 32, 34 of the stationary body 14, and may balance axial forces exerted in either axial direction $D_1$, $D_2$ by having the first and second magnets 28, 29 interact with the thrust bearing collar 16. The at least one magnet 27 may be a permanent magnet or the core of an electromagnet. Further, the direction in which any of the at least one magnet 27 biases the rotary body 12 may be reversed by reversing the polarity of the at least one magnet 27.

In exemplary embodiments, the at least one magnet 27 may be a plurality of magnets 27, each of which may be disposed either in the first body section 32 or the second body section 34. More particularly, the at least one magnet 27 may be a set of four magnets: a first magnet 28*a*, a second magnet 28*b*, a third magnet 29*a*, and a fourth magnet 29*b*. In an exemplary embodiment, the first magnet 28*a* and the second magnet 28*b* may be disposed in the first body section 32, and the third magnet 29*a* and the fourth magnet 29*b* may be disposed in the second body section 34. The four magnets 28*a*-*b* and 29*a*-*b* may each be disposed in a separate one of the grooves 36, 37 of each of the first and second body sections 32, 34. As shown, the first magnet 28*a* may be disposed in the groove 36 of the first body section 32, the second magnet 28*b* may be disposed in the groove 37 of the first body section 32, the third magnet 29*a* may be disposed in the groove 36 of the second body section 34, and the fourth magnet 29*b* may be disposed in the groove 37 of the second body section 34. In this arrangement, the first and third magnets 28*a*, 29*a* may be configured to bias the rotary body 12 in the axial direction $D_1$ and the second and fourth magnets 28*b*, 29*b* may be configured to bias the rotary body 12 in the axial direction $D_2$.

Furthermore, in an exemplary embodiment, the first body section 32 may include an annular pocket surface 39, which may also be described as a pocket, extending radially outward from the inner circumferential surface 32*c* of the first body section 32 of the stationary body 14. It will be appreciated, however, that in other exemplary embodiments, the second body section 34 may include the annular pocket surface 39, which may extend outwardly from the inner circumferential surface 34*c*. The annular pocket surface 39 may be configured to support the seal 24, which may be a labyrinth seal as described above, such that the seal 24 extends into the central bore 35. Additionally, the outer circumferential surfaces 32*d*, 34*d* of the first and second body sections 32, 34, respectively, may each be configured to engage a compressor structural member 6 such that the compressor structural member 6 retains the shaft support device 10 at a generally fixed position within the casing 2.

Referring to FIGS. 1 and 2, in an exemplary embodiment, the shaft support device 10 includes a radial bearing assembly 40 configured to support radial loading on the shaft 3. The radial bearing assembly 40 is at least partially disposed within the stationary body 14 and includes a base member 42, which is generally annular and is disposed at least partially within the central bore 35 of the second body section 34 of the stationary body 14. The radial bearing assembly 40 also has a central bore 43, as well as a radial bearing 44 disposed within the central bore 43, and is supported by the base member 42. The radial bearing 44 may be a rolling element bearing and may have a plurality of rolling cylinders 45. The radial bearing 44 may, however, be formed as any other type of bearing capable of supporting radial loading, such as a journal bearing, a ball bearing, a tapered roller bearing, etc. Further, the radial bearing assembly 40 includes a sealing member 46, which may be generally annular in shape, and is connected with the base member 42. The sealing member 46 may be spaced axially from the radial bearing 44, and may have an outer circumferential end 46*a* engaging the base member 42 and an inner circumferential end 46*b* configured to sealingly engage the shaft 3. The sealing member 46 may be a labyrinth seal, and may include a plurality of radially inwardly extending annular shoulders or "teeth" 48 that may slidably engage the shaft 3, but may be configured in any other appropriate manner.

Referring now to FIGS. 4 and 5, in an exemplary embodiment of the shaft support device 10, the inner portion 13*a* of the rotary body 12 provides the balance piston 18 and a first thrust bearing collar 17*a*. The outer portion 13*b* provides a second thrust bearing collar 17*b*, which may be a magnetic thrust bearing collar, as described above. It will be appreciated, however, that in other exemplary embodiments, the configuration of the inner and outer portions 13*a*, 13*b* may be reversed: the outer portion 13*b* may provide the thrust balance piston 18 and the first thrust bearing collar 17*a*, while the inner portion 13*a* provides the second thrust bearing collar 17*b*.

Further, in an exemplary embodiment, the inner portion 13*a* of the rotary body 12 includes a hub section 50 mounted on the shaft 3, a piston section 52 spaced radially outward from the hub section 50, and a collar section 54 that connects the hub section 50 and the piston section 52 and provides the first thrust bearing collar 17*a*. The hub section 50 is generally tubular and has a central bore 51 defined therein that is sized to receive a portion of the shaft 3, which may thereby couple the rotary body 12 with the shaft 3. The piston section 52, which is also generally tubular in shape and may thus be described as a tubular piston section, extends circumferentially about the hub section 50, and provides the first and second pressure surfaces 19*a*, 19*b*. Further, the collar section 54 extends generally radially between the hub section 50 and piston section 52, and has opposing radial engagement surfaces 55*a*, 55*b* that slidingly engage the first thrust bearing portion 21*a* of the stationary body 14, as described below.

In an exemplary embodiment, the outer portion 13*b* includes a disk 56, which is generally annular in shape and may also be known in the art as a thrust disk. The disk 56 extends radially outward from the piston section 52 of the inner portion 13*a* and thereby provides the second thrust bearing collar 17*b*. Additionally, the hub section 50, the piston section 52, the collar section 54, and the disk 56 may optionally be integrally formed, such that the rotary body 12 is of one-piece construction, but may also be formed of separate sections connected together by any appropriate means (e.g., welding, fasteners, etc.).

In an exemplary embodiment, the stationary body 14 includes the inner thrust bearing portion 21*a*, which slidingly engages the collar section 54 of the inner portion 13*a* of the rotary body 12. The stationary body 14 includes the outer thrust bearing portion 21*b*, which operatively engages the disk 56. In the exemplary embodiment, the disk 56 also provides the second thrust bearing collar 17*b*. The inner thrust bearing portion 21*a* includes first and second thrust bearing members 57*a*, 57*b*, respectively, which each slidingly engage a separate one of the radial engagement surfaces 55*a*, 55*b*, respectively, of the collar section 54. Each of the first and second thrust bearing members 57*a*, 57*b* includes a contact bearing member 58, which is generally annular and provides a fixed bearing surface 59 contactable with a proximal engagement surface 55*a*, 55*b*, respectively. The contact bearing member 58 may be fabricated of a sacrificial material, which is a soft and inexpensive material, for example carbon graphite, intended to absorb any wear that may result from regular use of a machine. In another exemplary embodiment, each of the first and the second thrust bearing members 57*a*, 57*b* may include a plurality of rolling contact elements, a plurality of tilt pads, or any other appropriate bearing element (not shown) instead of, or in addition to, the contact bearing member 58. Further, the second thrust bearing portion 21*b* may include the at least one magnet 27, the first and second magnets 28, 29, or the first through fourth magnets 28*a-b*, 29*a-b*, as described in detail above.

In an exemplary embodiment shown in FIGS. 4 and 5 the first body section 32 has a bearing mount 60, which extends radially inward and is configured to support the first thrust bearing member 57*a*. However, it will be appreciated that in other exemplary embodiments the second body section 34 may instead provide the bearing mount 60. Further, in the exemplary embodiment shown in FIGS. 4 and 5, the radial bearing assembly 40 is generally similar to the embodiment of the radial bearing assembly 40, shown in FIG. 1 and described above, except that the base member 42 includes a bearing mount 62 configured to support the second thrust bearing member 57*b*.

Referring to FIG. 6, in an exemplary embodiment of the shaft support device 10, the inner and outer portions 13*a*, 13*b* of the rotary body 12 each provide the thrust bearing collar 16. Accordingly, the thrust bearing collar 16 has two thrust bearing collars: a first thrust bearing collar 17*a* and a second thrust bearing collar 17*b*. The stationary body 14 includes the inner and outer thrust bearing portions 21*a*, 21*b*. The inner thrust bearing portion 21*a* slidingly engages the first thrust bearing collar 17*a*, creating a mechanical thrust bearing. The outer thrust bearing portion 21*b*, which may include the at least one magnet 27, engages the second thrust bearing collar 17*b*. It will be appreciated, however, that the configuration may be reversed: the inner thrust bearing portion 21*a* may include the at least one magnet 27 and the outer thrust bearing portion 21*b* may include one or more mechanical bearing members (structure not depicted). Further, additional bearing members may also be included in the configuration to support additional radial or axial loading. Thus, in an exemplary embodiment, the shaft support device 10 may not include a thrust balance piston and, as depicted in FIG. 6, may be formed without a radial bearing assembly.

In the exemplary embodiment of FIG. 6, the rotary body 12 further includes a disk 72 and a hub 70. The hub 70 is generally cylindrical, is mounted on the shaft 3, and has a central bore 71 defined therein, which is configured to receive a portion of the shaft 3. Further, the disk 72 is generally annular, extends radially outward from the hub 70, and provides the thrust bearing collars 17*a*, 17*b*. The disk 72 may have opposing radial surfaces 74, 76, which each have a radial inward section 74*a*, 76*a*, respectively. Each radially inward section 74*a*, 76*a* may slidingly engage the first thrust bearing portion 21*a* of the stationary body 14. The disk 72 may also have an outer disk portion 72*b*, which may be radial and may magnetically engage the second thrust bearing portion 21*b*. The inner radial portion 72*a* of the disk 72 is likewise engageable by the at least one magnet 27. The disk 72 may also have outer radial surface sections 74*b*, 76*b* each of which may slidingly engage stationary mechanical bearing elements (structure not depicted).

The shaft support device 10 of the exemplary embodiment shown in FIG. 6, does not include a thrust balance piston or a radial bearing assembly. As such, the first and second body sections 32, 34 are formed without clearance for a radial bearing or an annular pocket surface for a thrust balance piston seal. The first thrust bearing portion 21*a* also includes the first and second thrust bearing members 57*a*, 57*b*, which are axially spaced, and slidingly engage the radial inward sections 74*a*, 76*a*, respectively. Accordingly, the first and second body sections 32, 34 of the stationary body 14 each include the bearing mount 60, which extends inwardly, and are configured to support a separate one of the first and second thrust bearing members 57*a*, 57*b*.

By having a rotary body 12 that includes axially overlapping thrust bearing collar(s) 16 and/or balance piston(s) 18, the entire shaft support device 10 requires a reduced axial length in comparison with previous shaft support devices. As such, both the shaft 3 and the casing 2 may be formed with lesser shaft length, thereby reducing material costs and making the entire compressor more compact.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A shaft support device for a turbomachine comprising:

a rotary body connected to a shaft of the turbomachine and comprising an inner portion comprising a thrust balance piston, and an outer portion comprising a thrust bearing collar, wherein the outer portion is disposed at least partially radially outward from the inner portion and axially overlapping the inner portion; and a stationary body disposed in and fixably connected to a casing of the turbomachine, comprising a thrust bearing portion operatively engaging the thrust bearing collar of the outer portion of the rotary body, and sealingly engaging the inner portion of the rotary body.

2. The shaft support device of claim 1, wherein the inner and outer portions are integral such that the rotary body is substantially of one-piece construction.

3. The shaft support device of claim 1, wherein the thrust bearing portion of the stationary body includes at least one magnet configured to bias the outer portion of the rotary body in an axial direction.

4. The shaft support device of claim 1, wherein the stationary body further comprises a first body section and a second body section, the first and second body sections spaced axially apart to define a gap therebetween, wherein at least a portion of the outer portion of the rotary body is disposed in the gap, the stationary body further comprising a plurality of magnets, at least one of the plurality of magnets is disposed in the first body section and at least another one of the plurality of magnets is disposed in the second body sections, wherein the plurality of magnets magnetically bias the rotary body.

5. The shaft support device of claim 1, wherein:

the inner portion of the rotary body further comprises a hub section attached to the shaft, a piston section disposed around and spaced radially apart from the hub section, and a collar section extending between and connecting the hub and piston sections; and the stationary body further comprises a seal engaging the piston section, and an inner thrust bearing portion engaging the collar section.

6. The shaft support device as recited in claim 1, wherein the stationary body further comprises a radial bearing assembly configured to support radial loading on the shaft.

7. The shaft support device as recited in claim 6, wherein the stationary body further comprises an annular section defining a central bore, and the radial bearing assembly comprises a base member disposed at least partially in the central bore of the annular section, and a sealing member having an outer circumferential end configured to engage the base member and an inner circumferential end configured to sealingly engage the shaft.

8. A shaft support device for a turbomachine comprising:

a rotary body connected to a shaft of the turbomachine and comprising a first portion having a thrust balance piston and a second portion having a thrust bearing collar, wherein the first and second portions are axially overlapping; and a stationary body disposed in and fixably attached to a casing of the turbomachine and comprising a first thrust bearing portion disposed adjacent to and operatively engaging the first portion of the rotary body.

9. The shaft support device of claim 8, wherein the first portion of the rotary body extends radially outward from the second portion, and the second portion is attached to the shaft.

10. The shaft support device of claim 8, wherein the second portion of the rotary body extends radially outward from the first portion, and the first portion is attached to the shaft.

11. The shaft support device of claim 8, wherein the stationary body further comprises first and second body sections spaced axially apart to define a gap therebetween, wherein the second portion of the rotary body is at least partially disposed in the gap.

12. The shaft support device of claim 11, wherein the first thrust bearing portion of the stationary body comprises at least one magnet configured to magnetically bias the second portion of the rotary body.

13. The shaft support device of claim 12, wherein the at least one magnet is a plurality of magnets, each individual magnet of the plurality of magnets being disposed in the first body section or the second body section, wherein at least one of the plurality of magnets is configured to bias the second portion of the rotary body in a first axial direction, and at least another one of the plurality of magnets is configured to bias the second portion of the rotary body in a second axial direction, wherein the first and second axial directions are substantially opposing axial directions.

14. The shaft support device of claim 8, wherein:

the first portion of the rotary body further comprises a hub section connected to the shaft, a piston section disposed around the hub section and spaced radially apart from the hub section, the piston section having first and second axial ends and an outer circumferential surface extending between the first and second axial ends, wherein the first axial end is exposable to a source of relatively high pressure gas and the second axial end is exposable to a source of relatively low pressure gas, and a collar section extending between and connecting the hub and piston sections; and the stationary body further comprises a seal configured to sealingly engage the outer circumferential surface of the piston section of the rotary body and a second thrust bearing portion operatively engaging the collar section.

15. The shaft support device as recited in claim 8 wherein the stationary body further includes a radial bearing assembly configured to support radial loading on the shaft.

16. The shaft support device as recited in claim 15, wherein the stationary body further comprises an annular section defining a central bore and the radial bearing assembly comprises a base member disposed at least partially within the central bore of the annular section, and a sealing member having an outer circumferential end engaging the base member and an inner circumferential end configured to sealingly engage the shaft.

17. A shaft support device for a turbomachine comprising:

a rotary body connected to a shaft of the turbomachine, and comprising a plurality of thrust bearing collars, wherein each one of the plurality of thrust bearing collars is at least partially axially overlapping another one of the plurality of thrust bearing collars; and a stationary body disposed in and fixably connected to a casing of the turbomachine and comprising a plurality of thrust bearing portions, each one of the plurality of thrust bearing portions being disposed adjacent to and operatively engaging one of the plurality of thrust bearing collars.

18. The shaft support device of claim 17, wherein at least one of the plurality of thrust bearing portions includes at least one magnet configured to engage at least one of the plurality of thrust bearing collars to bias the rotary body in an axial direction and at least another one of the plurality of thrust bearing portions includes a plurality of rolling contact elements, a fixed bearing surface, or a plurality of tilt pads.

19. The shaft support device of claim 17, wherein:

the stationary body further comprises first and second body sections spaced axially apart to define a gap therebetween;

the rotary body is disposed further comprises a disk disposed at least partially in the gap; and a plurality of magnets each individually disposed in the first or second body sections and located in at least one of the plurality of thrust bearing portions, wherein at least one of the plurality of magnets is configured the bias the disk of the rotary body in a first axial direction, and at least another one of the plurality of magnets is configured to bias the disk of the rotary body in a second axial direction, wherein the first and second axial directions are opposing directions.

20. The shaft support device of claim 17, wherein the stationary body further comprises an annular section defining a central bore, and the shaft support device further comprises a radial bearing assembly configured to support radial loading on the shaft, wherein the radial bearing assembly comprises a base member disposed at least partially within the central bore of the annular section, and a sealing member having an outer circumferential end engaging the base member and an inner circumferential end configured to sealingly engage the shaft.

* * * * *